US008562265B2

(12) United States Patent
Hay

(10) Patent No.: US 8,562,265 B2
(45) Date of Patent: Oct. 22, 2013

(54) METHOD AND APPARATUS FOR TWIST LOCK MANIPULATION

(75) Inventor: Cameron Hay, Singapore (SG)

(73) Assignee: NSL Engineering Pte Ltd, Singapore (SG)

( * ) Notice: Subject to any disclaimer, the term of this patent is extended or adjusted under 35 U.S.C. 154(b) by 1111 days.

(21) Appl. No.: 12/525,843

(22) PCT Filed: Dec. 28, 2007

(86) PCT No.: PCT/SG2007/000444

§ 371 (c)(1), (2), (4) Date: Aug. 5, 2009

(87) PCT Pub. No.: WO2008/097195

PCT Pub. Date: Aug. 14, 2008

(65) Prior Publication Data

US 2010/0320265 A1 Dec. 23, 2010

(30) Foreign Application Priority Data

Feb. 7, 2007 (SG) ..... 200700797-4

(51) Int. Cl.
*B60P 7/00* (2006.01)

(52) U.S. Cl.
USPC ..... 410/82

(58) Field of Classification Search
USPC ..... 410/73, 76, 80, 82, 83; 29/700; 24/287; 294/81.53
See application file for complete search history.

(56) References Cited

U.S. PATENT DOCUMENTS 6,768,421 B1 7/2004 Alioto et al.
8,177,463 B2 * 5/2012 Walker ..... 410/84

FOREIGN PATENT DOCUMENTS

EP 0 594 061 A2 4/1994
EP 1 367 022 A2 12/2003
WO WO 2006/024071 A1 3/2006

* cited by examiner

*Primary Examiner* — Stephen Gordon
(74) *Attorney, Agent, or Firm* — Alston & Bird LLP

(57) ABSTRACT

A manipulation device (5) for either securing a twist-lock to a shipping container or releasing it therefrom or both, the device (5) comprising an engagement element (20) operative to engage and rotate at least a portion of the twist-lock so as to secure the twist-lock in the shipping container or to release it therefrom; a support member (15) disposed above the an engagement element (20), the support member (15) being arranged to receive and support a mid region of the twist-lock while allowing a lower portion of the supported twist-lock to protect below the member to be engagable with the an engagement element (20), said support member (15) being in the form of a plate incorporating at least one aperture allowing the lower portion of the supported twist-lock to protect below the plate; wherein said support member (15) is selectively movable out of alignment with an axis of rotation of the twist-lock.

15 Claims, 8 Drawing Sheets

METHOD AND APPARATUS FOR TWIST LOCK MANIPULATION

FIELD OF THE INVENTION

The invention relates to the handling of freight through the use of intermodal devices such as containers, flat racks and similar devices applicable for use with engagement devices such as twist-locks.

In particular, the invention relates to methods and devices for the engagement and disengagement of twist-locks from said intermodal devices.

BACKGROUND

Twist-locks are used for securing shipping containers to ships and to each other. Twist-locks are mounted on the bottom and top of shipping containers and thereby multiple containers can be joined in a vertical stack. When shipping containers have been lifted off the ship by a crane the twist-locks must be removed before the containers are taken to another location. Furthermore, when the containers are loaded onto a vessel, twist-locks must be fitted at the wharf to secure containers on board the vessel. Typically, securing or removing twist-locks is via manual handling of the twist-locks from the lower corner casting of a shipping container held approximately 1 to 1.8 meters above the ground by the crane.

This operation is dangerous as the stevedore must manually handle the twist-locks which are quite heavy and work under or adjacent suspended loads in a high traffic area. It is also inefficient as it can take one to three minutes to fit the twist-locks, thereby slowing the crane cycle time. It is also labour cost intensive since two men are often allocated to undertake such a task.

Methods and devices to alleviate this labour intensive task have been proposed including that disclosed in PCT/AU2005/001258, the contents of which are incorporated herein by reference.

An issue with such devices is the removal and storage of the twist-lock devices having been disengaged from the container. Whilst the device of PCT/AU2005/001258 reduces the bottleneck of the process by speeding the removal of the twist-locks, a further bottleneck may be created by the removal of the twist-locks from the device and subsequent storage. Whilst alternatives have been proposed to achieve this, a simpler and cheaper option would provide further advantage to the process.

At the same time, security concerns as to the contents of said containers must be taken into consideration. Without due cause, it is not viable to search containers for, for instance, fissile or radio active material which may represent a security concern. Nevertheless, means for considering whether a container contains such volatile material should be provided. A system to detect fissile material within a container is disclosed in U.S. Pat. No. 6,768,421, the contents of which are incorporated herein by reference. Here a spreader has been adapted to include detection apparatus for detecting radioactive material or potentially radioactive shielding material within the container. This system involves the use of detectors placed within a spreader which is used to lift a container through engagement with the container through twist-lock devices. The accuracy of this system is, however, dependent on the relative movement between the spreader and the container, and movement within a changing environment as the container is shifted from the ship to the wharf. To alleviate the effects of these factors, the spreader would need to engage the container and stay stationary for a sufficient amount of time to record an accurate reading. However, this would potentially result in a bottleneck in the process of handling the container.

It would, therefore, be advantageous if data collection were possible within the overall process so as to reduce the potential for a bottleneck.

SUMMARY OF THE INVENTION

In a first aspect, the invention provides a manipulation device for either securing a twist-lock to a shipping container or releasing it therefrom or both, the device comprising engagement means operative to engage and rotate at least a portion of the twist-lock so as to secure the twist lock in the shipping container or to release it therefrom; a support member disposed above the engagement means, the support member being arranged to receive and support a mid region of the twist-lock whilst allowing a lower portion of the supported twist-lock to project below the member to be engagable with the engagement means; said support member being in the form of a plate incorporating at least one aperture allowing the lower portion of the supported twist-lock to project below the plate; wherein said support member is selectively movable out of alignment with an axis of rotation of the twist-lock.

In a second aspect, the invention provides a storage bin for storing twist lock devices, comprising said storage bin having a housing, a floor and an internal assembly, said floor and assembly within said housing; said internal assembly for biasing the floor of said bin upwards using a resilient biasing assembly; said resilient biasing assembly capable of applying sufficient force to overcome the weight of a pre-determined number of twist lock devices wherein a number in excess of said pre-determined number being of a force to overcome said force and consequently leading to a lowering of the floor.

In a third aspect, the invention provides a storage rack assembly for storing twist lock devices comprising a plurality of elongate racks for receiving twist lock devices in sliding engagement; a drive arrangement to which said plurality of racks are mounted; said drive arrangement capable of moving said racks to discreet positions, said positions including at least one position whereupon twist lock devices may be received by at least one rack and an unloading position where at least one rack may unload twist lock devices.

Accordingly, by shifting the position of support member so as to be out of alignment with the axis of rotation of the engagement means a twist-lock supported by the support means may be placed in a more favourable position to facilitate removal than would otherwise be the case.

In a preferred embodiment, moving the twist-lock from out of alignment with the axis of rotation may be achieved through rotation of the support member about an axis parallel to but not co-linear with the axis of rotation of the engagement means.

In an alternative embodiment, the support member may be selectively rotatable about an axis not parallel to the axis of rotation of the engagement means. In a more preferred embodiment, the support member may be selectively rotatable about an axis at right angle to the axis of rotation of the engagement means. In this case, the support member may be pivoted about said axis so as to move the plane defined by the support member so as to be inclined.

In a more preferred embodiment, moving said plane may cause the twist-lock to shift through gravity so as to self disengaged from said support member. Said self disengagement may be through sliding or falling from the support member through inclination of the plane defined by the support member.

In a preferred embodiment, movement of the support member may be through biasing by an actuator, said actuator may be hydraulic/electric or pneumatic.

In a more preferred embodiment, the actuator may be a rotation actuator so as to rotate the support member out of alignment with the axis of the rotation of the engagement member. Alternatively, the actuator may be a linear actuator such that the actuator biases the support member so as to pivot the support member and, consequently inclining the plane defined by the support member.

In a preferred embodiment, the support member may be movable in a direction of the axis of rotation of the engagement means. Alternatively, the engagement means may be movable relative to the support member in the direction of the axis of rotation.

In a further preferred embodiment, both the support member and the engagement means may be movable in the direction of axis of rotation.

In a preferred embodiment, the manipulation device may comprise a frame incorporating both the engagement means and the support member such that the frame is movable in the direction of axis of rotation.

In a preferred embodiment, the frame may be arranged to be within a housing such that the frame is movable relative to the housing in the direction of axis of rotation.

In a fourth aspect, the invention provides a data collection station comprising a frame for receiving a shipping container on an upper surface; data collection apparatus for measuring at least one of: radiation emissions from the container, optical scanning of identification code on the container, detection of an RFID or an electronic seal of the container, and weight of the container whilst said container is engaged with said frame, and; a device for communication of said collected data.

In one embodiment, the invention provides a data collection station that combines a necessary process whilst collecting data from the container. In this case, twist-lock devices need to be removed from the container before moving to a container yard or alternatively attached before loading to a ship. This provides an opportunity to collect data on the container whilst the twist-locks are added or removed. Accordingly data can be taken without interfering with the process as the residence time for collecting said data is no longer part of the critical path but is simultaneously taken during an existing step within the process. For instance, if said data collection is the detection of radiation emissions from the container, these can be measured and communicated during the twist-lock manipulation period and so satisfy security requirements in assessing each container without interfering with the process.

Accordingly, in a fifth aspect, the invention provides a method for processing a shipping container including the steps of: placing a container on a data collection station; either removing or attaching twist-lock devices to/from the container using manipulation devices; substantially simultaneously collecting data associated with the shipping container using data collection apparatus, whilst removing or attaching said twist-locks.

It is, however, not essential for the data collection station to be combined with the process of removing or attaching twist-locks to the containers. In other words, the frame of the data collection station may be provided with the data collection apparatus and without a manipulation device for removing or attaching twist-locks to the container.

The type of data collection may be varied and may include any one or a combination of detection of radiation emissions, detection of RFID and electronic seal, weight and optical character recognition (OCR) scanning of the identification code of the container. This may be particularly useful in that the emissions and/or weight may then be recorded with the associated container identification code for storing in a central database.

The data collection may further be beneficial in that whilst OCR measurement and weight are often taken at the entry point of a terminal, said information is not recorded dockside and so the data collection station, being proximate to the ship provides for a further opportunity for gathering data prior to or subsequent to loading from a ship.

Further, the data collected at the data collection station may be combined with data collected at the entry point to the terminal so as to provide supporting information as to the progress of a container through the entry point and subsequently to a ship or the same process in reverse. Accordingly the location of several said data collection stations around the wharf all connected to a central database to which the terminal entry point may also be connected, may provide a fully integrated data collection system to assist in the tracking of containers through the terminal as they enter the terminal from land or sea.

BRIEF DESCRIPTION OF DRAWINGS

It will be convenient to further, describe the present invention with respect to the accompanying drawings that illustrate possible arrangements of the invention. Other arrangements of the invention are possible and, consequently the particularly of the accompanying drawings is not to be understood as superseding the generality of that preceding description of the invention.

DESCRIPTION OF PREFERRED EMBODIMENT

Intermodal devices, such as shipping containers are characterised by their ability to be engaged by standardised connections for the purpose of engaging said containers to lift or for securing multiple containers in place.

One example of said standardised connection is a twist-lock which acts to engage two containers lying one on top of the other. The twist-lock is placed intermediate the containers engaging both so as to hold both together.

Figures 1A, 1B, 1C:
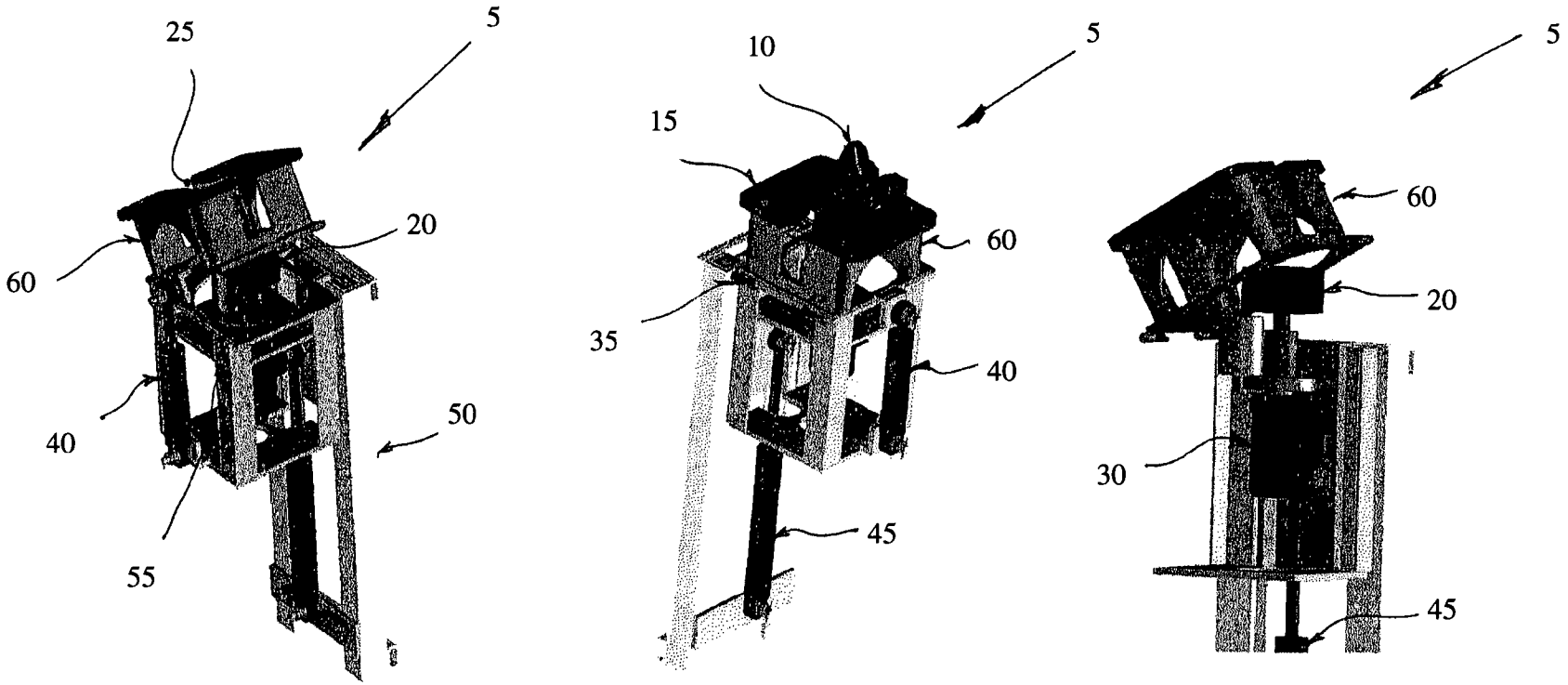
FIGS. 1A to 1C are isometric views of a manipulation device according to one embodiment of the present invention.

The invention relates to a manipulation device 5 for engaging and disengaging said twist-locks from a container with FIGS. 1A to C showing various views of said device 5.

The manipulation device 5 comprises an assembly 55, 60 mounted to a frame 50. The assembly 55, 60 has an upper section 60 engaged with the lower section 55 with the engagement being through hinges 35. With the lower section 55 engaged with the frame 50, the upper section 60 is free to pivot about the hinges 35 relative to the lower section 55. To control this pivotal movement there is mounted between the upper and lower section 55, 60, a hydraulic ram 40 such that on extension of the ram 40, the upper section 60 selectively pivots relative to the lower section 55.

The upper section 60 includes a support member 15 being a plate having a slot 25 into which the twist-lock 10 is inserted. The slot 25 and plate 15 are arranged such that the twist-lock 10 sits on the plate 15 with the upper portion of the twist-lock 10 extending above the plate 15 and the lower portion extending below the plate 15.

Mounted to the lower section 55 is an engagement member 20 comprising a U-shaped bracket which is shaped to receive and engage the lower portion of the twist-lock 10 as it extends below the plate 15. Further, the engagement member 20 is mounted to a motor 30 capable of selectively rotating the engagement member 20 about an axis co-linear with the vertical axis of the engagement member.

The twist-lock, on insertion into the manipulation device 5, is supported by the plate 15 and engaged by the engagement member 20, whereupon the lower portion of the twist-lock is rotated by the motor 30. This rotation is sufficient to either engage the upper portion of the twist-lock with a container or alternatively to disengage the upper portion of the twist-lock from a container. In the case of the twist-lock 10 being disengaged from a container, on removal from the container, the twist-lock is then free to be removed from the manipulation device 5.

The steps to disengage the twist-lock from the manipulation device 5 commence with the engagement member 20 disengaging from the twist-lock. This is achieved by activating the actuator 45 to lower the engagement member 20. The actuator 45 has sufficient stroke on the ram to move the engagement member 20 clear of the twist-lock whilst supported by the plate 15. Next, the pivoting actuator 40 is extended biasing the upper section 60 which consequently rotates about the hinges 35 tilting the upper section 60 and, consequently the plate 15. As the slot 25, in which the twist-lock 10 is positioned, permits free sliding movement of the twist-lock 10, the twist-lock is then free to slide out of engagement from the upper section 60, by gravity. The twist-lock 10 may fall into a containment area such as the storage bin 70 shown in FIG. 2 or, alternatively, to slide into engagement with the rack 100 shown in FIG. 3. In a still further embodiment, the twist-lock 10 may be more easily removed from the manipulation device 5 given the free sliding nature of the twist-lock 10 with the upper section 60 in the inclined position.

Figure 2:
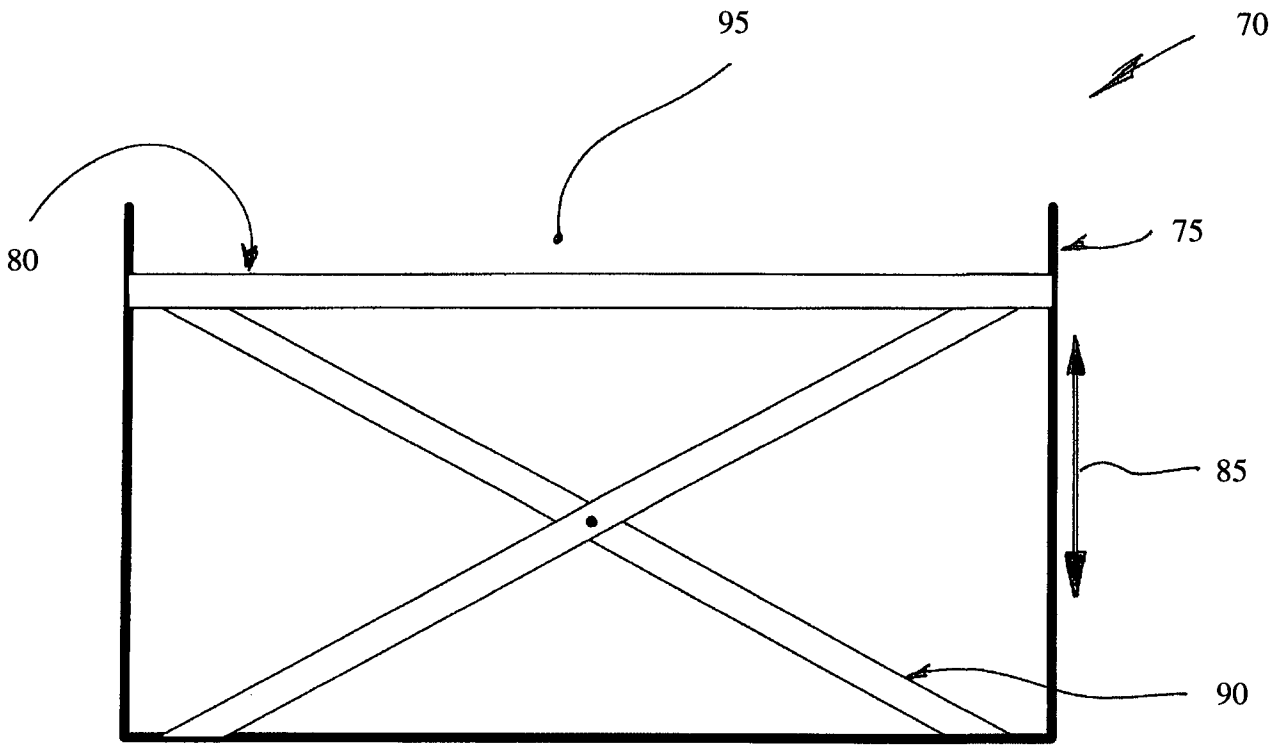
FIG. 2 is a cross-sectional elevation view of a storage bin according to one embodiment of the present invention.

FIG. 2 shows a purpose-built storage bin 70 according to one embodiment of the present invention. The storage bin 70 is adapted to receive the twist-locks 10 that are disengaged from the manipulation device 5. Said twist-locks fall within the space 95 defined by the outer shell 75 of the bin and the movable floor 80. The movable floor 80 is supported by a scissor lift arrangement 90 which is biased by a resilient assembly such as a hydraulic ram or spring arrangement such that the number of twist-locks within the cavity 95 defines the position of the movable floor 80 relative to the other shell 75. Said movable floor 80 is operable up or down 85 according to the position of the scissor lift 90 which in turn, because of the resilient assembly, is subject to the number of twist-lock within the cavity 95.

The resilient assembly is such that when a single layer, or less, of twist-locks are located within the cavity 95, the movable floor 80 is at its highest position. As subsequent twist-locks are added, the floor 80 will progressively move down as the outer shell 75 progressively fills. The movable floor 80 is intended to provide the available twist-locks within the cavity 95 at a convenient height so that, irrespective of the number of twist-locks within the bin 70, there will always be twist-locks available adjacent the top of the bin 70 for convenient access by those requiring said twist-locks.

Figure 3:
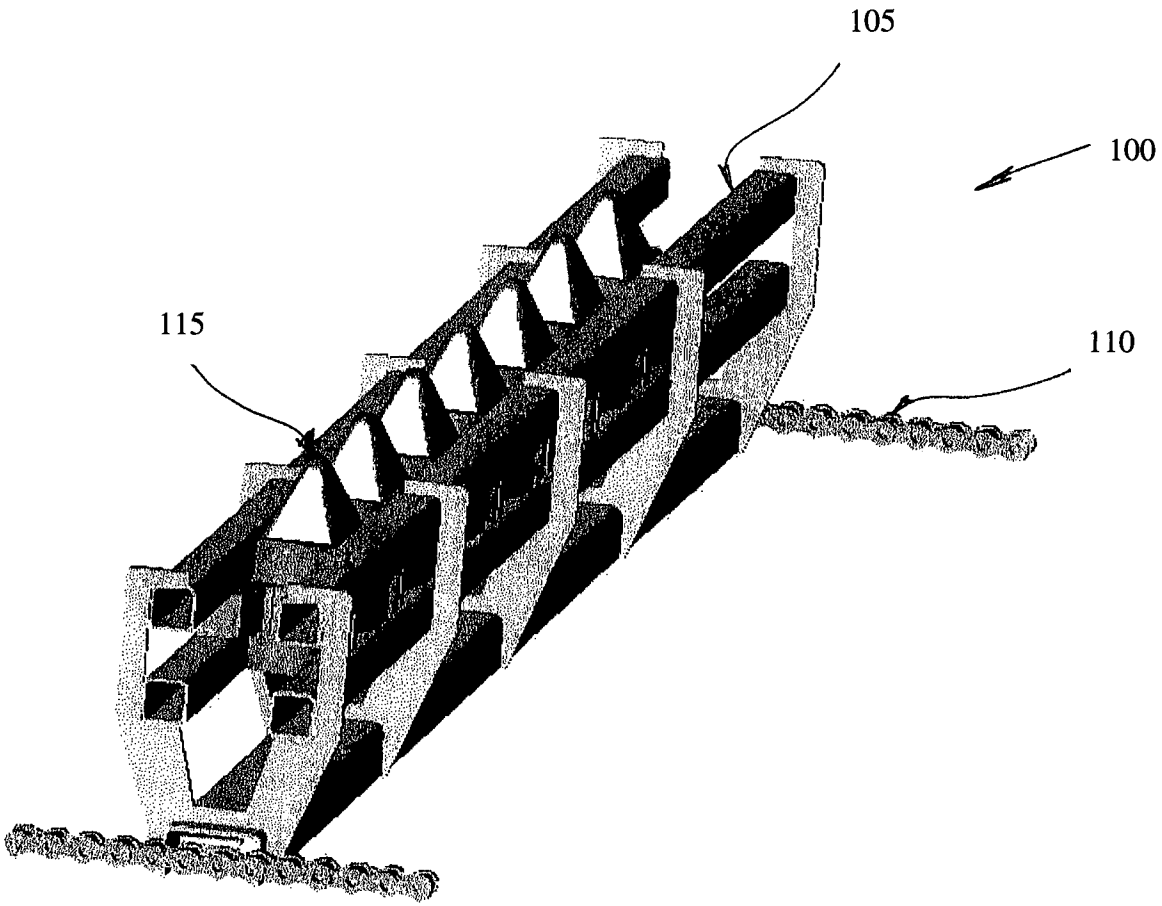
FIG. 3 is an isometric view of a rack according to one embodiment of the present invention.

FIG. 3 shows an alternative, or a complementary, storage system for said twist-locks. Here a rack 100 mounted to a chain drive 110 includes a frame 105 into which a finite number of twist-locks 115 may be slotted. Whilst this rack 100 cannot contain a comparable number of twist-locks to the bin 70, it does maintain the twist-locks 115 in a pre-determined orientation such that a user can more easily mount said twist-locks or alternatively permit the automation of the positioning of the twist-locks ready for engagement within the manipulation device 5. Further, multiple rows of the frames 105 may be mounted to the chain drive 110 such that a larger number of twist-locks are available within the same rack system 100.

Figure 4:
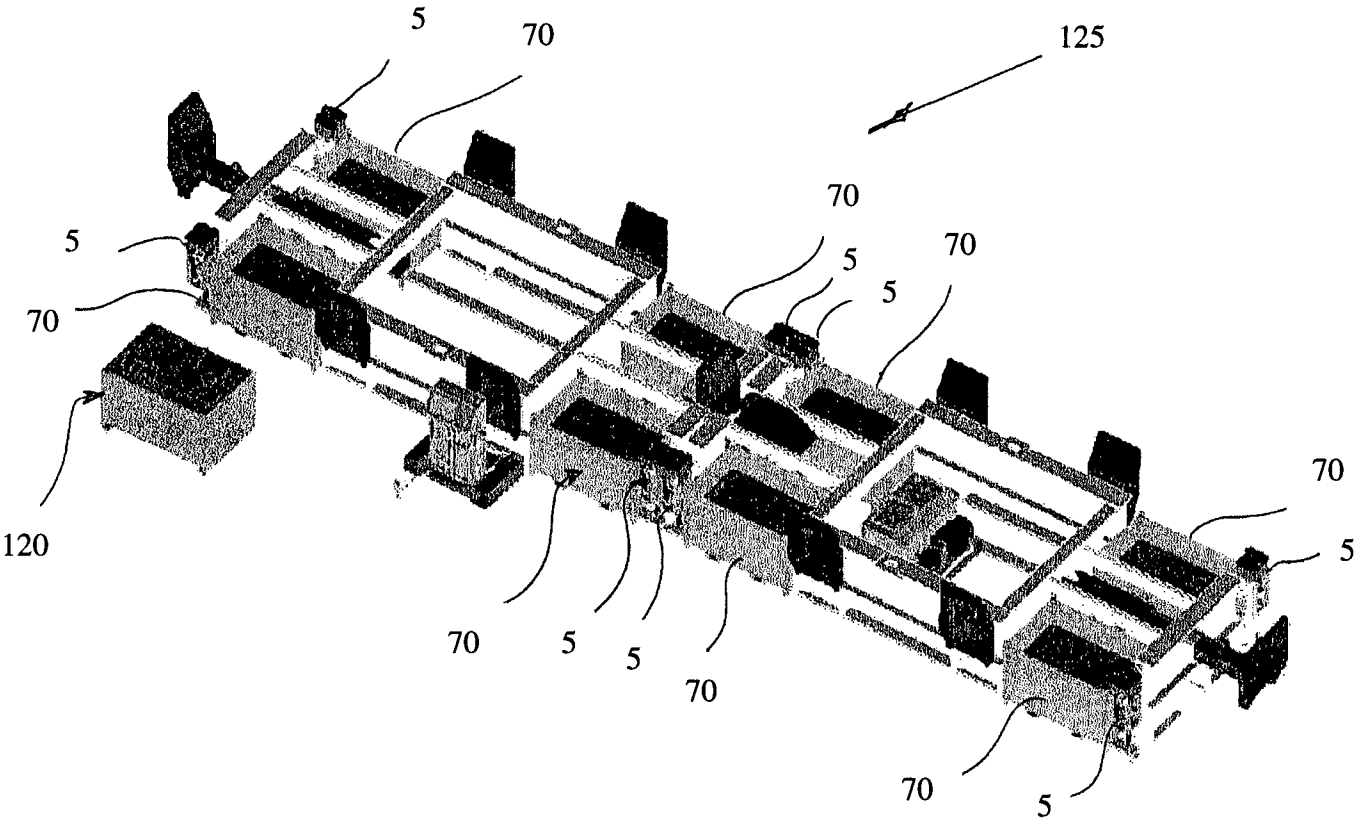
FIG. 4 is an isometric view of a support platform according to one embodiment of the present invention.

FIG. 4 shows a platform 125 onto which a container (not shown) may be placed. In this embodiment the support platform 125 is sized to receive two 20 foot containers end to end or alternatively a single 40 foot container. The support platform 125 in this embodiment is configurable between the 20 foot and 40 foot containers, as can be seen by the placement of manipulation devices 5, and corresponding storage bins 70, intermediate the extreme ends of said support platform 125. Accordingly there are further manipulation devices and corresponding bins placed at the corners of the support platform 125 to correspond with the connection points of either the extreme ends of a 40 foot container or ends of, end to end, 20 foot containers placed upon the support platform. Further, each manipulation device 5 includes a bin 70 into which twist-locks may be placed after being removed from the respective manipulation devices 5 or, alternatively, conveniently placed so as to permit a user to withdraw a twist-lock from the bin 70 and place it within the manipulation device ready for engagement with a container placed on said support platform 125.

Figure 5:
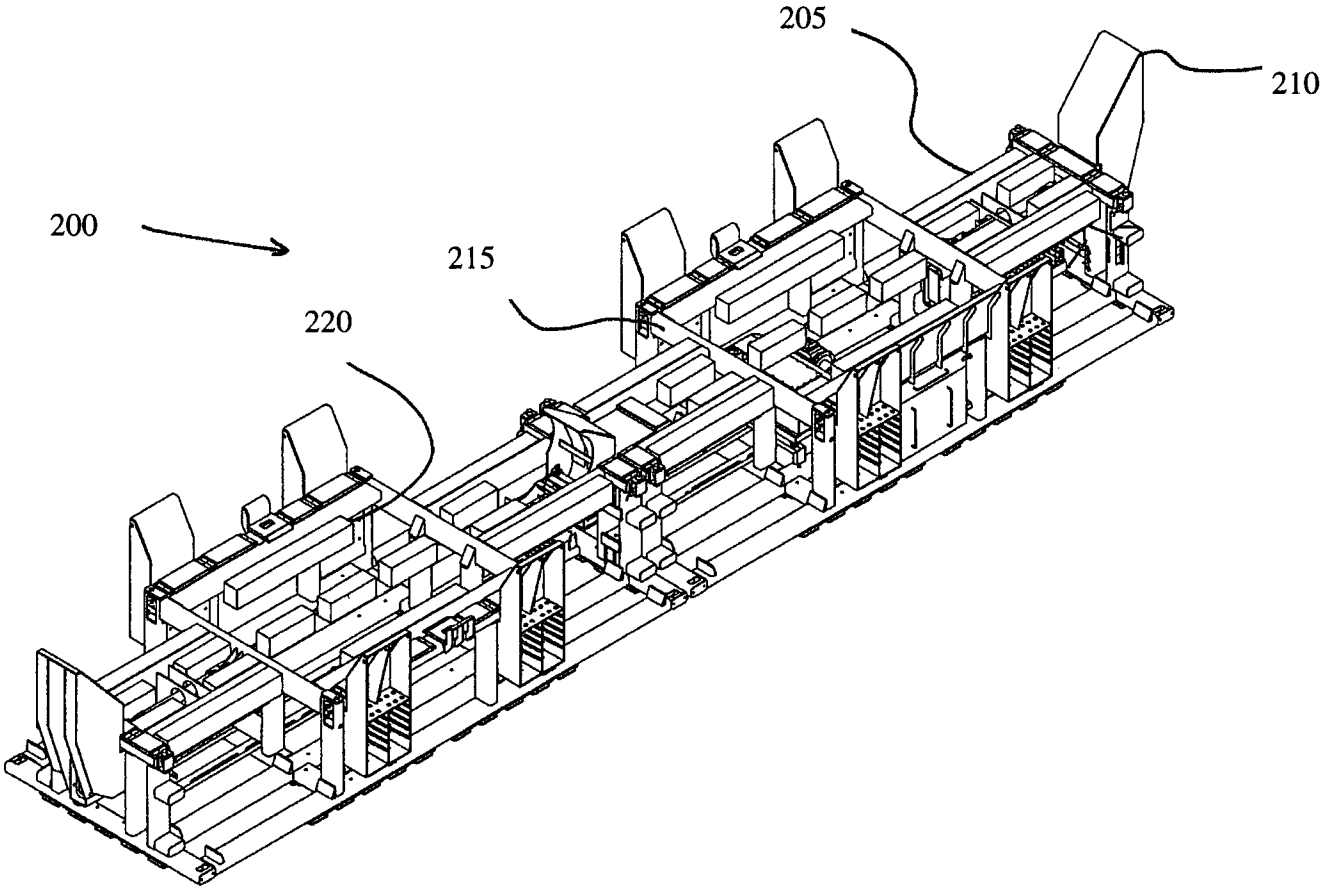
FIG. 5 is an isometric view of a data collection station according to one embodiment of the present invention.
Figure 6:
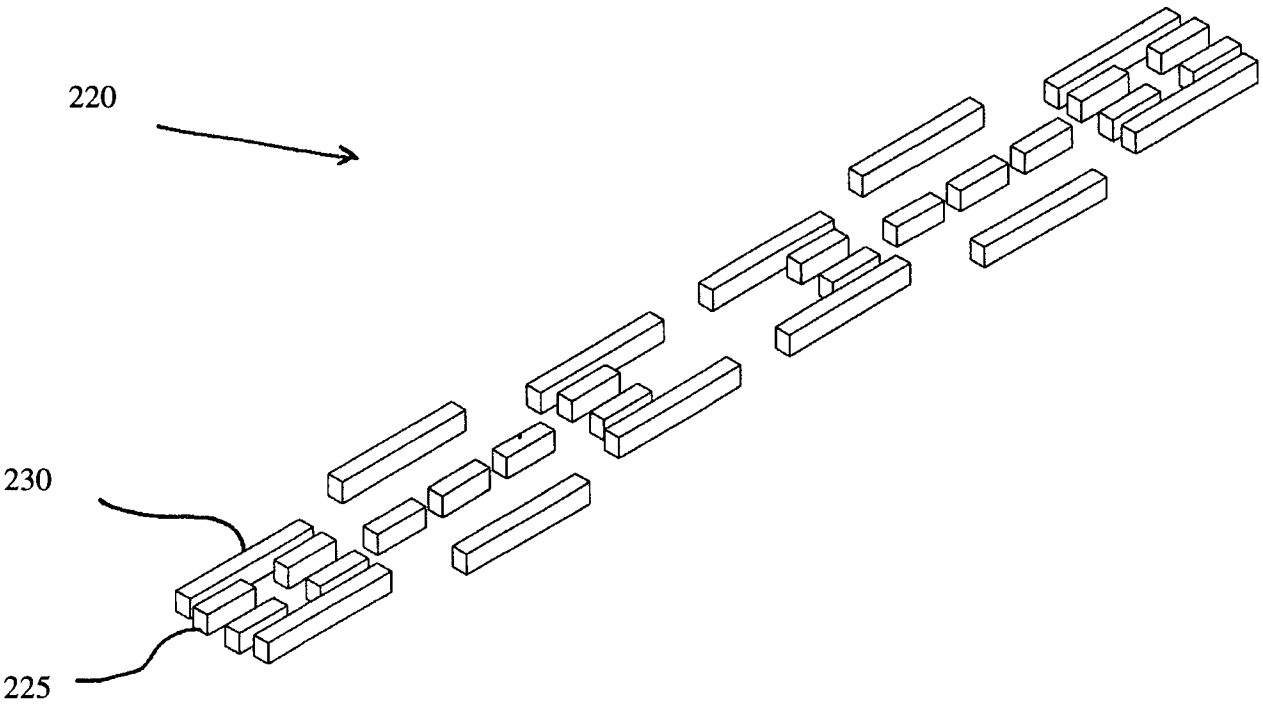
FIG. 6 is an isometric view of the distribution of radiation detection units within the station shown in FIG. 5.

FIG. 5 shows a data collection station 200 according to one embodiment of the present invention. The data collection station 200, in this case, comprises a frame 205 having an upper portion 215 ready to receive a container placed thereupon. The upper surface 215 includes an array of radiation detection units 220 distributed throughout the upper surface 215 of the frame 205. The frame 205 further includes guides 210 which provide an added tolerance for the placement of the container. The container may be positioned in close proximity to the frame and contacts the guides 210 which provide the final fine adjustment for placing the container. FIG. 6 shows the arrangement of the array of radiation detection units 220 with the frame removed for clarity. In this embodiment, the radiation detection units 220 include neutron radiation detection units (NRDU) 230 placed on the periphery of the array 220 with smaller gamma radiation detection units (GRDU) 225 placed within the NRDUs 230. Whilst this arrangement is adapted for use with NRDUs and GRDUs, additional detection units could be included including detection units for x-ray radiation, biological warfare, chemical warfare and conventional explosives. This array of radiation detection and chemical detection may be placed within the data collection unit 200 together with the NRDUs and GRDUs or in place thereof subject to the security requirements of the terminal.

Figure 7:
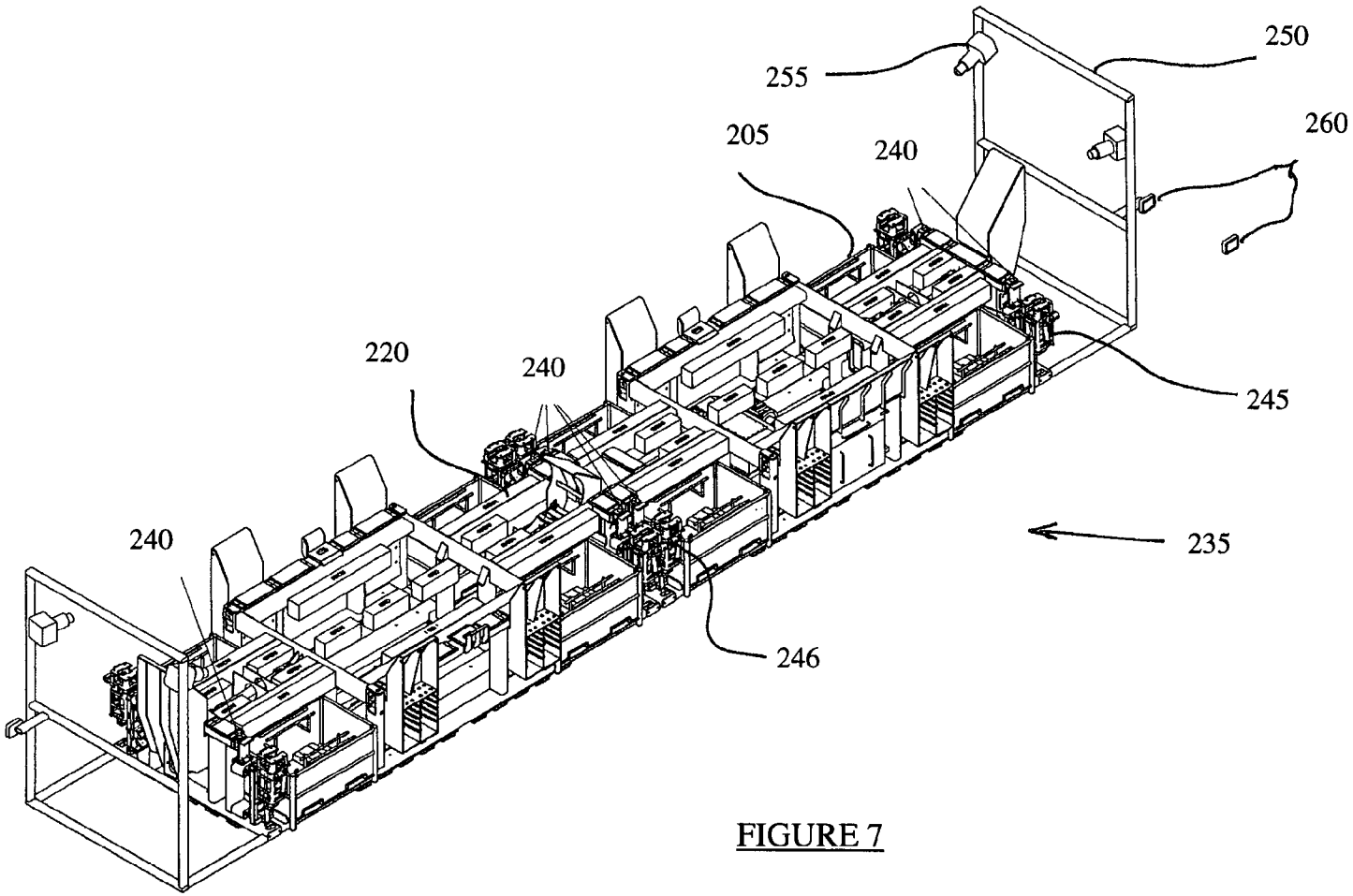
FIG. 7 is an isometric view of a data collection station according to a further embodiment of the present invention.
Figure 8:
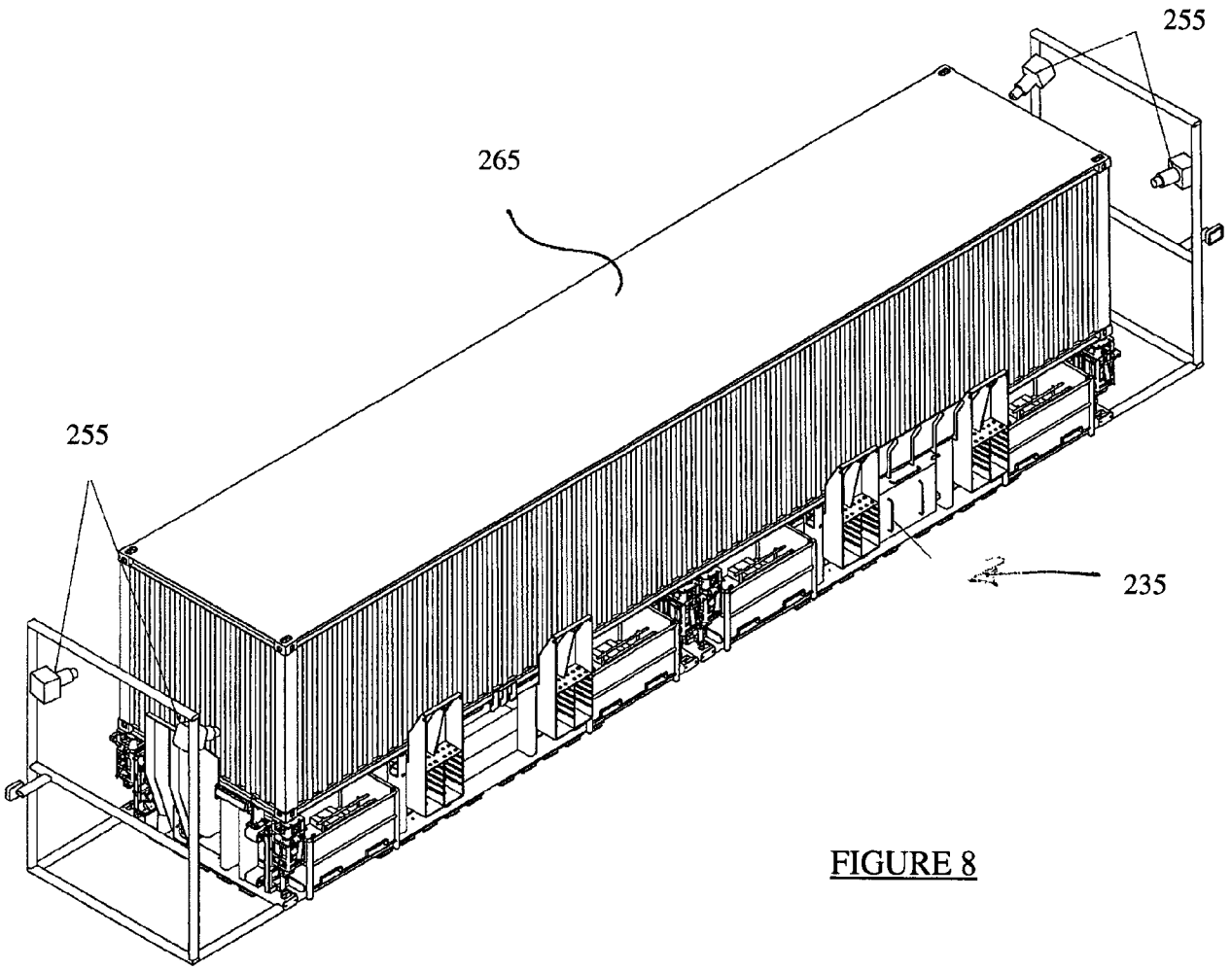
FIG. 8 is an isometric view of the data collection station of FIG. 7 with a container in place.

FIGS. 7 and 8 show a further embodiment of the data collection station 235 according to the present invention. Again, the array of radiation detection units 220 has been incorporated within the frame 205. Further included are twist-lock manipulation devices 245 located so as to align with the twist-locks of the container placed thereon. In this case, the frame 205 is arranged to accept either a 40 foot container or two 20 foot containers. Accordingly manipulation devices 245 have been placed at each end of the frame 205 to correspond to corners of a 40 foot container, with further manipulation devices 246 located intermediate the end devices 245 to accommodate twist-locks for 20 foot containers placed end to end.

Further, the data collection station 235 includes load cells 240 which are placed so as to be intermediate the container 265 and the frame 205 and so the weight of the container when placed thereon can be measured or detected.

Further still, the data collection station 235 includes optical character recognition (OCR) apparatus 250 which are placed so as to read the identification code on the container 265. The OCR apparatus 250 include cameras 255 placed strategically around the data collection station 235 so as to align with the positions of said identification code for such a container. The data collection station 235 may further include OCR apparatus (not shown) intermediate the end frames 250 to accommodate 20 foot containers.

Further still, the data collection station 235 includes one or more radio frequency identification (RFID) detectors and/or electronic seal detectors (not shown) which are placed so as to read an identification code or other information that are stored on an RFID tag or electronic seal on/in the container 265.

Accordingly, the data collection station 235 according to this embodiment fulfils several purposes including registering the container through the OCR apparatus 250 (or the RFID/electronic seal detectors) to which can be linked the weight of the container through load cells 240. This information may be collected and collated by a communication device such as a control system (not shown) associated with the data collection station 235. Further still, any radiation emissions associated with the container can be detected and recorded against the identified container. Further still all of this can be achieved during the normal process of automatically removing the twist-lock devices from the container or alternatively, placing said twist-locks onto the container subject to whether the container has just been removed from a ship or is about to be placed on a ship. Thus, the data collection station 235 is capable of recording a significant amount of information which may be stored on a central database (not shown) which may be accommodated within the terminal or recorded locally by a control system (not shown) within the data collection station 235. It follows, therefore, that this significant amount of information including weight and radiation emission can be recorded against the identified container during the normal process of attachment or removal of the twist-lock devices. This provides the logistic and economic advantage of collecting such useful information without interfering with the normal procedures for which a container must follow within the terminal.

The invention claimed is:

1. A manipulation device for either securing a twist-lock to a shipping container or releasing it therefrom or both, the device comprising engagement means operative to engage and rotate at least a portion of the twist-lock so as to secure the twist lock in the shipping container or to release it therefrom;

a support member disposed above the engagement means, the support member being arranged to receive and support a mid region of the twist-lock whilst allowing a lower portion of the supported twist-lock to project below the member to be engagable with the engagement means;

said support member being in the form of a plate incorporating at least one aperture allowing the lower portion of the supported twist-lock to project below the plate;

wherein said support member is selectively movable out of alignment with an axis of rotation of the twist-lock.

2. A manipulation device according to claim 1, wherein the support member is arranged such that the selective movement of the support member causes the twist lock to disengage from said device.

3. A manipulation device according to claim 1, wherein said support member is selectively pivotable.

4. A manipulation device according to claim 3, wherein said support member is selectively pivotable about a pivotting axis perpendicular to the axis of rotation.

5. A manipulation device according to claim 3, wherein said support member is selectively pivotable about a pivotting axis parallel to the axis of rotation.

6. A manipulation device according to claim 1, wherein the support member is movable in a direction of an axis of rotation of the engagement means.

7. A manipulation device according to claim 1, wherein the engagement means is movable relative to the support member in a direction of an axis of rotation of the engagement means.

8. A manipulation device according to claim 1, wherein both the engagement means and the support member are movable in a direction of an axis of rotation of the engagement means.

9. A manipulation device according to claim 1, further comprising a frame incorporating the engagement means and the support member, wherein in use, the frame is movable in a direction of an axis of rotation of the engagement means.

10. A manipulation device according to claim 9, further comprising a housing wherein the frame is disposed within the housing and movable relative to the housing in the direction of the axis of rotation of the engagement means.

11. A manipulation device according to claim 10, further comprising a height adjustment assembly operative to move the frame relative to the housing in the direction of the axis of rotation of the engagement means.

12. A manipulation device according to claim 1, wherein the engagement means comprises a plurality of elements that are movable between a retracted and extended position such that a recess operative to receive the twist-lock is formed on retracting selected areas of the elements.

13. A manipulation device according to claim 12, wherein the engagement means comprises a base plate and side plates, such that at least one of the base plates or the side plates are extendable to vary the size or shape of a recess for receiving a twist-lock.

14. A manipulation device according to claim 1, wherein the engagement means is in the form of jaws which are operable to grip the twist-lock disposed in the manipulation device.

15. A manipulation device according to claim 1, further comprising an actuator operative to release a locking mechanism disposed on the twist-lock.

* * * * *